US005085263A

United States Patent [19]

Deussen et al.

[11] Patent Number: 5,085,263

[45] Date of Patent: Feb. 4, 1992

[54] CONTINUOUS CASTING MOLD

[75] Inventors: Josef Deussen, Heinsberg; Dieter Böttger, Düsseldorf, both of Fed. Rep. of Germany

[73] Assignee: SMS Schloemann-Siemag Aktiengesellschaft, Dusseldorf, Fed. Rep. of Germany

[21] Appl. No.: 580,862

[22] Filed: Sep. 11, 1990

[30] Foreign Application Priority Data

Sep. 11, 1989 [DE] Fed. Rep. of Germany ..... 3930265

[51] Int. Cl.[5] ..... B22D 11/04

[52] U.S. Cl. ..... 164/436; 164/491

[58] Field of Search ..... 164/418, 436, 491

[56] References Cited

U.S. PATENT DOCUMENTS 3,375,865 4/1968 Boichenko ..... 164/436

4,147,202 4/1979 Gay ..... 164/436

FOREIGN PATENT DOCUMENTS 53-1131 1/1978 Japan ..... 164/436

*Primary Examiner*—Kuang Y. Lin

*Attorney, Agent, or Firm*—Toren, McGeady & Associates

[57] ABSTRACT

A continuous casting mold includes two long side walls which are arranged opposite each other on support frames. For the purpose of adjusting the width of the mold, short side walls which can be moved toward each other are tightly clamped between the long side walls. Mechanical clamping elements which are in connection with hydraulic piston-cylinder units are provided for chucking the short side walls between the long side walls. The support frames with the long side walls are arranged in the continuous casting mold and are connected to the clamping elements in such a way that they can be moved toward each other as well as apart from each other.

6 Claims, 5 Drawing Sheets

CONTINUOUS CASTING MOLD

BACKGROUND OF THE INVENTION

1. Field of the Invention

The present invention relates to a continuous casting mold. The mold includes two long side walls which are arranged opposite each other on support frames. For the purpose of adjusting the width of the mold, short side walls which can be moved toward each other are tightly clamped between the long side walls. Mechanical clamping elements are provided for clamping the short side walls between the long side walls. The mechanical clamping elements are in operative connection with hydraulic piston-cylinder units.

2. Description of the Related Art

In a patent application which has not yet been published, a continuous steel casting mold of the above-mentioned type is described in which the mechanical clamping elements for clamping the short side walls between the long side walls are compression springs whose clamping forces can be adjusted by means of hydraulic cylinders which are arranged in parallel. The clamping forces generated by the compression springs are designed increased in accordance with the contact force required for adjusting the short side walls and the hydraulic compression cylinders can be operated so as to reduce the contact force. In addition, only one of the two support frames to which the long side walls are fastened is arranged so as to be adjustable in the continuous casting mold. This construction of the continuous steel casting mold makes possible in a simple manner an exact adjustment of the contact forces and an increased operational safety from opening of the long side walls during casting. The long side walls are usually arranged parallel to each in order to keep as small as possible the adjustment distance of one of the support frames.

SUMMARY OF THE INVENTION

It is the object of the present invention to further improve the above-described continuous casting mold, particularly with respect to its manner of operation and maintenance. In addition, continuous casting molds having a funnel-shaped cross-section of the long side walls relative to each other are to be constructed in such a way that an adjustment from both sides is possible, for example, as it is required in the case of a breakout which makes necessary a greater adjustment distance.

In accordance with the present invention, the support frames with the long side walls are arranged in the continuous casting mold and are connected to the clamping elements in such a way that they can be moved toward each other as well as apart from each other.

As a result of the above-described feature, the support frames with the long side walls of the continuous casting mold can be spread apart from each other to such an extent that the short side walls arranged at the support plates are accessible from both sides, can be disassembled very easily together with the support plates and can be replaced if necessary. Also, cleaning of the continuous casting mold in the areas of the short side walls as well as the maintenance of the continuous casting mold are substantially simplified and facilitated.

The support frames with the long side walls are very advantageously arranged in the continuous casting mold and connected to the clamping elements in such a way that they can be spread by approximately 70 mm on each side. As a result, the end of the beam blank can be exposed in the area of the mold and the mold can be easily disassembled. Thus, in accordance with the invention, the mold can be very easily lifted up after a breakout above the funnel-shaped end of the beam blank which has solidified in the mold.

In accordance with an advantageous further development of the invention, the mechanical clamping elements are resiliently elastic pull rods of steel which connect the two support frames at the long side walls thereof. These resiliently elastic pull rods fully absorb the tensional forces occurring during the casting procedure of the metal beam blank, so that stacks of plate springs are unnecessary.

In accordance with another advantageous embodiment of the invention, the resiliently elastic pull rods are provided at one end thereof with a groove into which a key is inserted when the short side walls are clamped. This key is in operative connection with a hydraulic piston-cylinder unit through a push rod and a swivel bearing.

This embodiment of the invention makes possible a simple clamping with a hydraulic piston-cylinder unit. Thus, a sufficiently tight clamping and locking of the short side walls between the long side walls are possible through both resiliently elastic pull rods simultaneously.

Moreover, in accordance with another advantageous embodiment of the invention, the support frames are provided with guide rails which are slidingly guided on guide members. As a result, the support frame, particularly the stationary side, assumes with its long side walls again exactly the same original position after opening or spreading and, thus, a subsequent alignment of the centering chucks is unnecessary.

Finally, in accordance with another advantageous embodiment of the present invention, the short side members which support the short side walls and are constructed as water chucking plates are arranged so as to be non-adjustable and are rigidly connected to the lifting table for the mold. This makes it unnecessary to displace the water chucking plate on the sealing rings and it is also not necessary to perform a time-consuming mounting of a hose during assembly and disassembly of the continuous casting mold.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
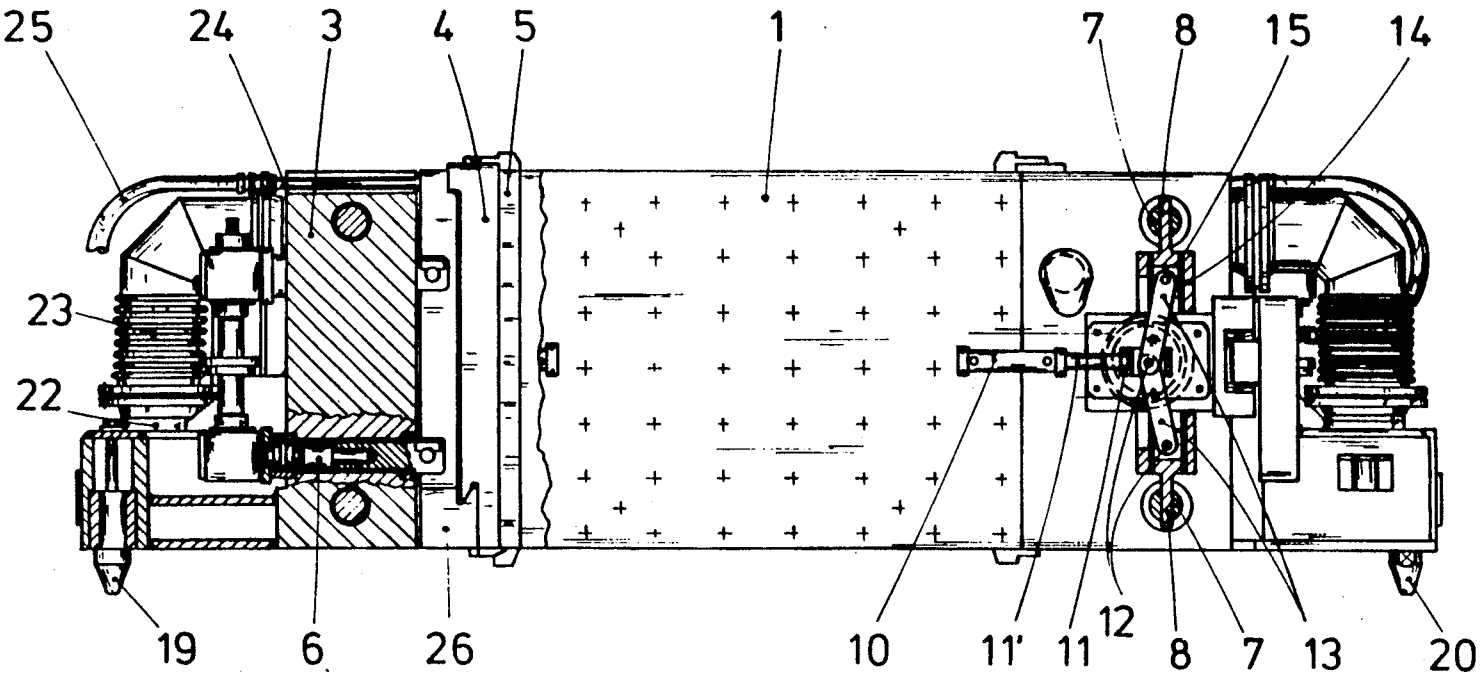
FIG. 1 is a side elevational view of a continuous casting mold according to the present invention.
Figure 2:
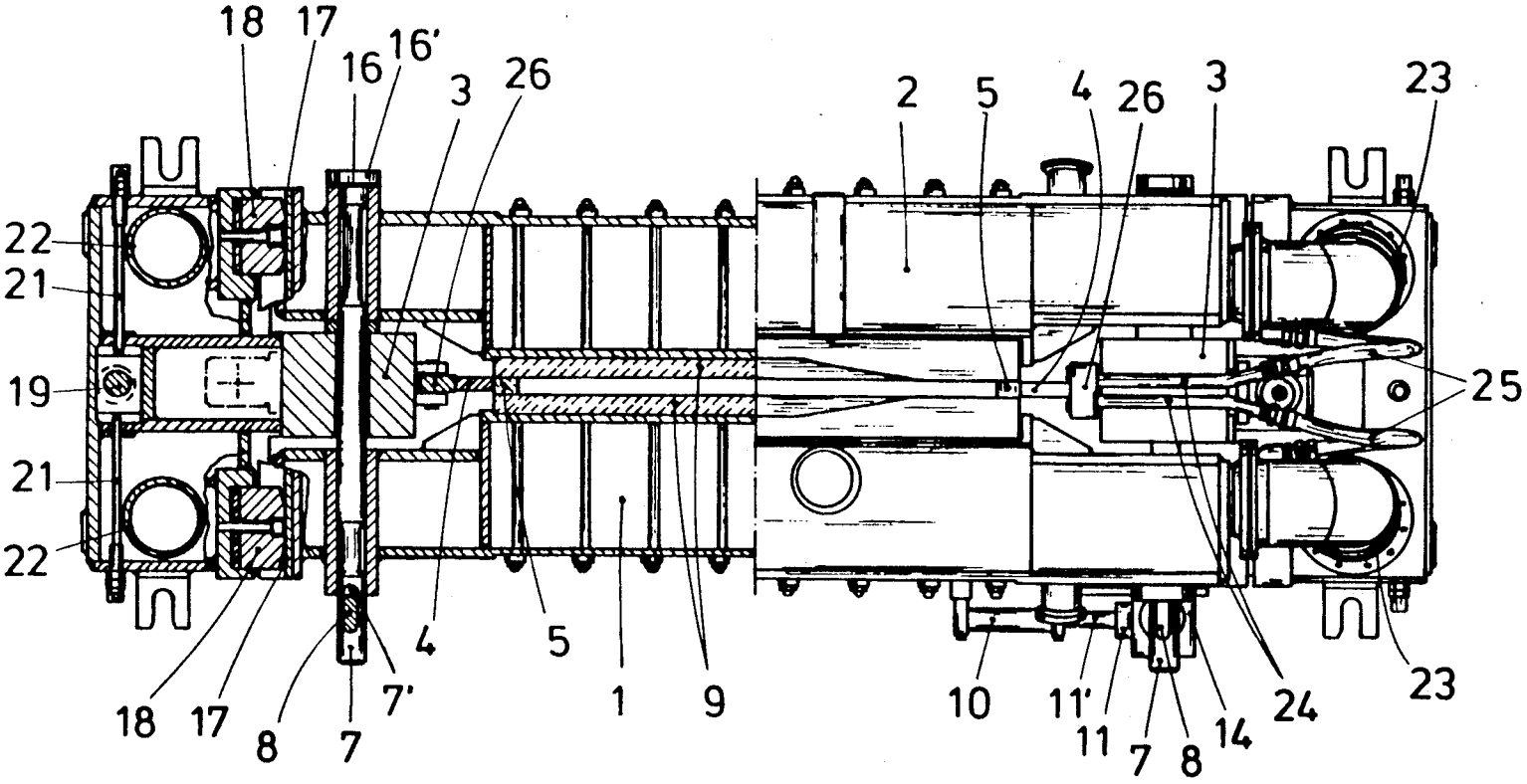
FIG. 2 is a top view, partially in section, of the continuous casting mold of FIG. 1 shown in closed position.

As illustrated in FIGS. 1 and 2 of the drawing, the continuous casting mold according to the present invention includes a support frame 1 for the detachable side and a support frame 2 for the stationary side as well as the short side members 3 and the support plates 4. The long side walls 9 are arranged on the inside on the support frames 1 and 2 and the short side walls 5 are arranged on the support plates 4. The long side walls 9 as well as the short side walls 5 are copper plates and are releasably connected to the support frames 1, 2 and the support plates 4 by means of screws which are not illustrated in the drawing. In addition, the continuous casting mold has on both sides thereof a short side adjusting device 6, as it is illustrated in a sectional view on the left hand side of FIG. 1.

Figure 4:
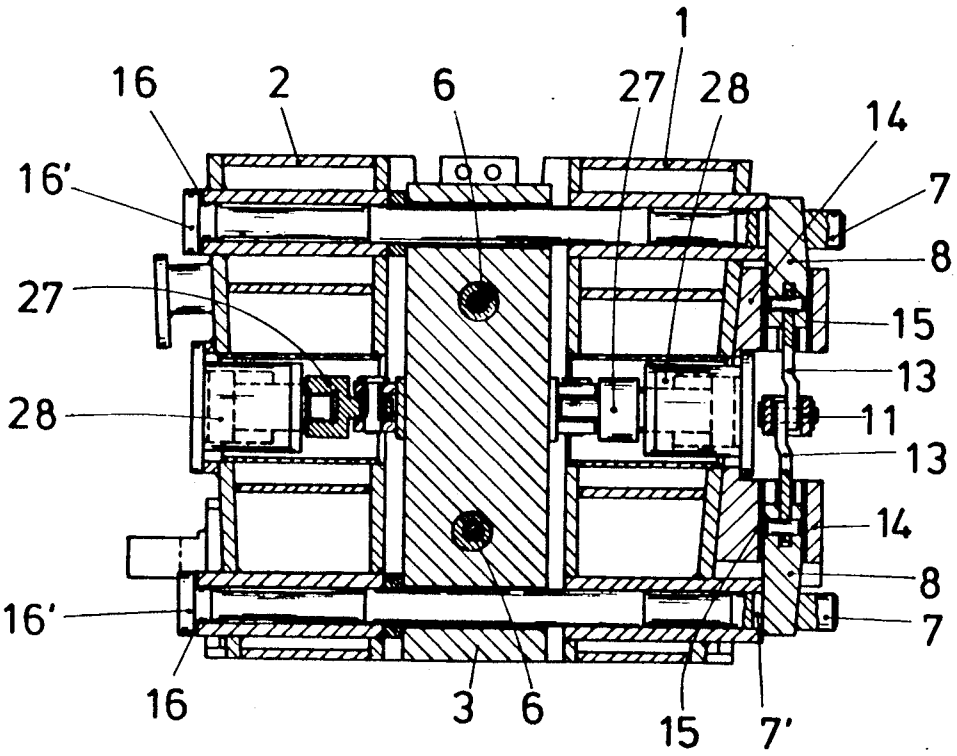
FIG. 4 is a sectional view of the resiliently elastic pull rods in the clamped position with clamping device.
Figure 5:
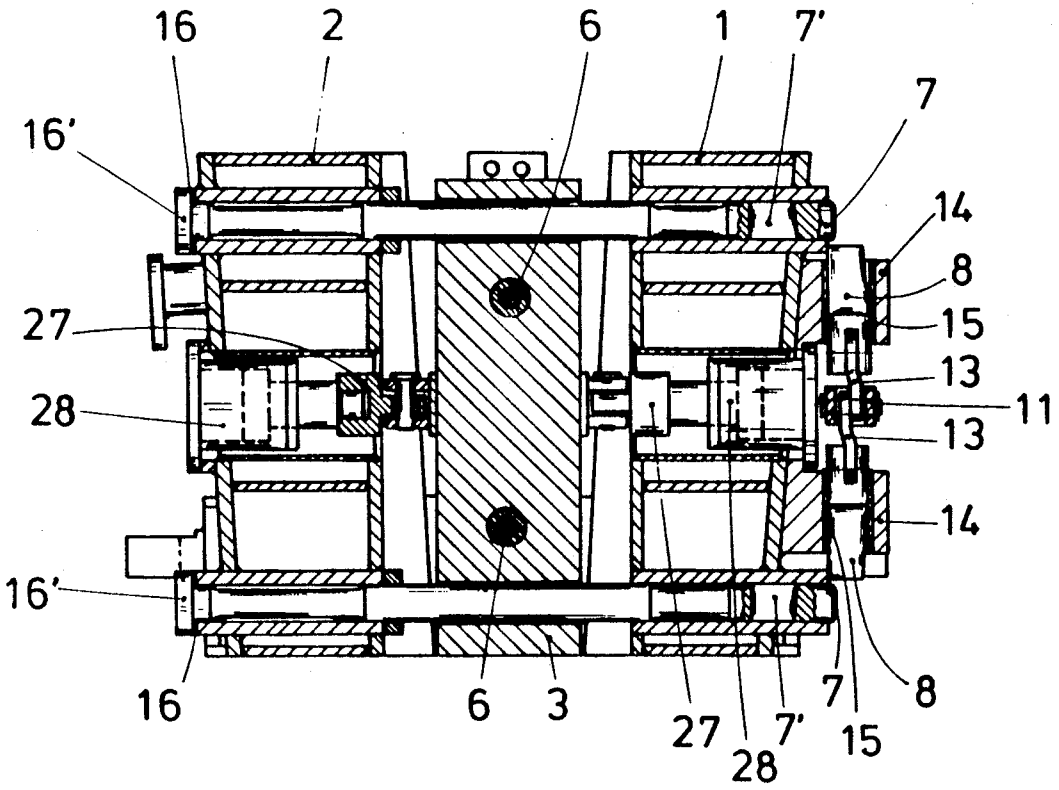
FIG. 5 is a sectional view of the resiliently elastic pull rods in the released open position with clamping device.

In accordance with the invention, the two support frames 1, 2 with their oppositely located long side walls 9 are tightly clamped against the short side walls 5 by means of resiliently elastic pull rods 7 and keys 8 which serve as clamping elements. For this purpose, each resiliently elastic pull rod 7 is provided at an end thereof with a groove 7' into which the key 8 is inserted when the short side walls 5 are clamped between the long side walls 9. Clamping is effected by means of a hydraulic piston-cylinder unit 10 which, as particularly illustrated in FIGS. 4 and 5, is in operative connection with the key or keys 8 through a swivel bearing 11 and push rods 13. The necessary contact pressure force of the long side walls 9 against the short side walls 5 can be very easily and exactly adjusted by means of the pressure which acts from the hydraulic cylinder of the hydraulic piston-cylinder unit 10 on the clamping element or key 8.

As shown in FIG. 1, the swivel bearing 11 is screwed onto the piston rod 11, of the hydraulic cylinder of the piston-cylinder unit 10, so that the assembly and disassembly of the piston-cylinder unit 10 is simplified. The swivel bearing 11 which is releasably connected to the piston rod 11' of the piston-cylinder unit 10 is connected, on the one hand, through a bolt 12 to the two push rods 13 and, on the other hand, to the clamping elements constructed as keys 8. A bushing 15 arranged in a bearing body 14 serves to guide the keys 8. The bearing body 14 itself is welded to the support frame 1 of the detachable side.

The resiliently elastic pull rods 7 have a collar 16' each by means of which they are tightly screwed to the support frame 2 on the stationary side. In order to ensure that the positions of the grooves 7' arranged on the pull rods 7 coincide particularly when changes of the thickness of the casting beam blank occur, shims 16 for compensating for the dimensional differences are arranged between the collar 16' and the support frame 2, as particularly illustrated in FIG. 4.

Figure 3:
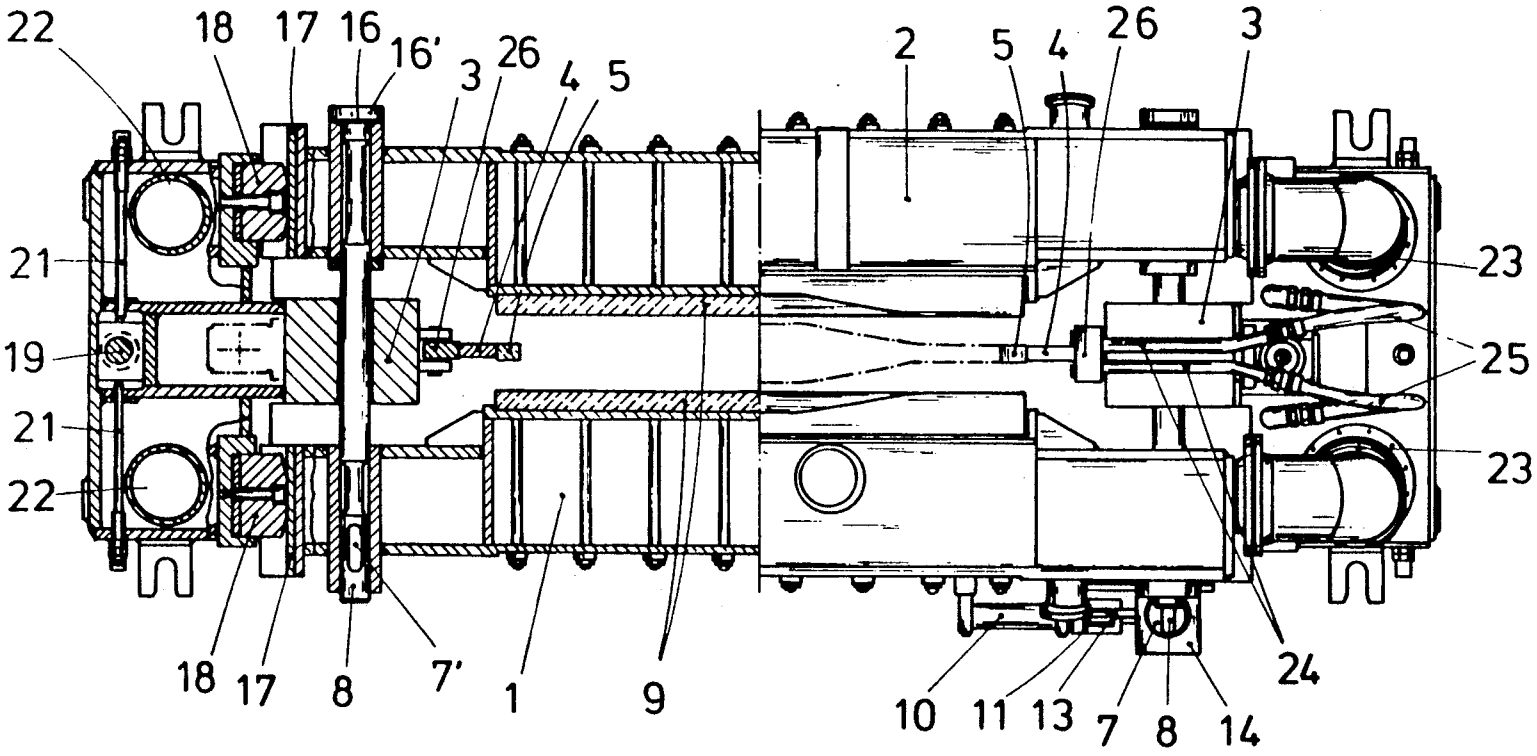
FIG. 3 is a top view, partially in section, of the continuous casting mold of FIG. 1 shown in open position.

As illustrated in FIG. 4, two hydraulic cylinders 28 each are screwed to the support frames 1, 2 of the stationary side and the detachable side between the pull rods 7. The hydraulic cylinders 28 serve for spreading the support frames 1, 2 with the long side walls 9. This requires a prior uncoupling of the keys 8 which serve as clamping elements by means of the hydraulic piston-cylinder unit 10 into the unlocked position illustrated in FIG. 5. Subsequently, the support frames 1, 2 can be moved very advantageously with the long side walls 9 relative to the short side walls 5 by approximately 70 mm toward each side into the open position illustrated in FIG. 3.

Moreover, the hydraulic cylinders 28 reduce the load acting on the short side walls 5 when the width of the mold is changed. In the open position of the support frames 1, 2 with the long side walls 9 illustrated in FIG. 3, the continuous casting mold can be easily emptied after a breakout or overflow above the end of the beam blank in the region of the mold. Because of the large opening width of the mold, the end of the beam blank is exposed even in the region of the pouring gate which is not illustrated in detail in the drawing. In addition, the adjusting device of the continuous casting mold constructed in accordance with the present invention substantially simplifies cleaning and maintenance of the short side walls 5 and the long side walls 9 and the replacement of the support plates 4 of the short side. Moreover, the adjusting and clamping device according to the invention can also be used in conventional molds with parallel long side walls. The opening width of the mold may also be smaller, for example, less than 70 mm.

If a change of the mold width is necessary during the operation of the continuous casting mold by displacing the short side walls 5, the hydraulic cylinders 28 on the detachable side reduce the load acting on the short side walls 5. This results in a further pretensioning of the resiliently elastic pull rod 7. In the open state of the continuous casting mold, the support plates 4 can be exchanged even during a casting interruption. The two support frames 1, 2 supporting the long side walls 9 are provided with two guide rails 17 each which are guided in guide pieces 18 and are vertically centered.

The two short side members 3 have different centering blocks 19, 20 for the stationary side and for the detachable side. The centering blocks 19, 20 are aligned by means of adjusting screws 21. The contact surfaces of the short side members 3 are advantageously constructed as water chucking plates. From the mold lifting device which is not illustrated in detail in the drawing, the cooling water is conducted through the water chucking plate, pipe lines 22 and compensators 23 to the long side walls 9 and through pipe lines 24, hoses 25 and the short wall side support 26 to the short side walls 5. The guide column of the short side member 3 serves to receive the short side adjusting unit 6, serves as contact surface for the stationary side support frame 2, serves to guide the pull rods 7 and serves to fasten the pivot bearing 27.

The present invention is not limited to the embodiment illustrated in the drawings. For example, the support frame 1 on the detachable side carrying the long side wall may also be clamped against the short side walls 5 by means of four plate spring stacks. In this case, the support frame 2 on the stationary side is clamped against the short side member by means of a pull rod, a spacer ring is placed between the middle member and the support frame on the stationary side, wherein the spacer ring determines the position of the stationary side for centering.

For opening the detachable side, pressure is applied to the hollow piston cylinder until the plate springs no longer exert a pulling force on the pull rod. Subsequently, the brackets on the short side member are lifted and the locking bolt is turned into the open position. The support frames on the stationary side and on the detachable side are then moved outwardly by means of the hydraulic cylinder. The closing procedure is carried in reverse sequence.

In accordance with another feature of the continuous casting mold according to the present invention, the pull rod may also very advantageously be constructed as an elastic expansion element, so that stacks of plate springs and hollow piston-cylinders are unnecessary.

In accordance with a different feature of the invention, the stationary side is pulled by means of two double-acting piston-cylinders against the short side member. The detachable side is also pulled against the short side walls by means of two double-acting piston-cylinders. In this case, tie rod, plate springs and hollow piston-cylinders are not used. The forces occurring during casting in the mold are absorbed and compensated by the hydraulic cylinders. Opening and closing of the mold as well as reducing the load on the short side walls when the width of the casting beam blank is changed is also effected by means of the hydraulic cylinders.

While a specific embodiment of the invention has been shown and described in detail to illustrate the application of the inventive principles, it will be understood that the invention may be embodied otherwise without departing from such principles.

I claim:

1. In a continuous casting mold, the mold including two long side walls mounted opposite each other on support frames, and short side walls clamped between the long side walls, wherein the short side walls are movable toward each other for the purpose of adjusting the width of the mold, mechanical clamping elements for chucking the short side walls between the long side walls, wherein the mechanical clamping elements are connected to hydraulic piston-cylinder units, the support frames with the long side walls being arranged in the continuous casting mold and being connected to the clamping elements such that the support frames can be moved toward each other and apart from each other and wherein the mechanical clamping elements are pull rods, the pull rods connecting the two support frames, the improvement comprising the pull rods each having at an end thereof a groove, means for inserting a key into each groove when chucking the short side walls, wherein the key is in connection through a push rod and a swivel bearing with a hydraulic piston-cylinder unit, such that a contact pressure force of the long side walls acting on the short side walls is exactly adjustable by the pressure acting from the hydraulic piston-cylinder unit on the key.

2. The continuous casting mold according to claim 1, wherein the support frames can be moved by approximately 70 mm on each side relative to the short side walls.

3. The continuous casting mold according to claim 1, wherein each support frame has guide rails, the guide rails being slidingly guided on guide members.

4. The continuous casting mold according to claim 1, comprising short side members supporting the short side walls, the short side members being water chucking plates.

5. The continuous casting mold according to claim 1, wherein the swivel bearing is connected to a piston rod of the piston-cylinder unit, the swivel bearing being connected through a bolt to the push rod and to the clamping elements.

6. The continuous casting mold according to claim 1, comprising two hydraulic cylinders each screwed to the support frames between the pull rod for spreading the support frames with the long side walls.

* * * * *